United States Patent [19]

Schreindl

[11] Patent Number: 4,906,025

[45] Date of Patent: Mar. 6, 1990

[54] MEMORANDUM WRISTBAND

[76] Inventor: Deana L. Schreindl, 545 Shell Pkwy. #3203, Redwood City, Calif. 94065

[21] Appl. No.: 248,118

[22] Filed: Sep. 23, 1988

[51] Int. Cl.[4] ..... B42D 3/00

[52] U.S. Cl. ..... 281/45; 281/51; 281/2; 224/219; 224/267

[58] Field of Search ..... 281/1, 45, 2; 224/219, 224/267

[56] References Cited

U.S. PATENT DOCUMENTS

| | | | |
|---|---|---|---|
| 753,457 | 3/1904 | Weissbrod | 224/219 |
| 1,407,239 | 2/1922 | Weiss . | |
| 1,427,891 | 9/1922 | Ziegler . | |
| 1,539,781 | 5/1925 | Smythe . | |
| 1,701,888 | 2/1929 | Hofferberth . | |
| 2,553,676 | 5/1951 | Roos . | |
| 2,776,848 | 1/1957 | Stupell . | |

*Primary Examiner*—Douglas D. Watts
*Assistant Examiner*—Thomas Hamill, Jr.

[57] ABSTRACT

A wristband is provided with a rectangular write-on surfaced mounting plate fastened centrally between opened ends on the outer surface of the wristband in longitudinal alignment with the wristband. The wristband is adjustable to the wrist size of the wearer and can be worn around the wearer's wrist held by fasteners attaching the opened ends together. The surface of the mounting plate is a smooth non-porous plastic designed to be written on with dry-erase markers and erased by wiping with a tissue. A snap-on transparent covering is provided to prevent smearing the writing. The transparent covering is replaceable by a decorative opaque cap. The caps can be snapped onto the mounting base. Some caps are hinged to one end of the mounting base and snap down over the other end. Writing on the write-on mounting base or on an inserted card can be viewed through the transparent covering. When the decorative opaque covering is in use, a small concealed storage space is provided between the cover and the write-on surface of the mounting base.

7 Claims, 3 Drawing Sheets

MEMORANDUM WRISTBAND

BACKGROUND OF THE INVENTION

1. Field of the Invention

This invention relates to wristbands in general and more specifically to an adjustable wristband having a write-on surfaced mounting plate with attachable coverings externally fastened to the wristband.

2. Description of the Prior Art

To ascertain development in past art devices, a patent search was conducted in the following classes and subclasses: 281/1. 30, 39, 224/219, 255.

The following patents were thought to be most pertinent:

Patent number 1,151,940, issued to J. Gauvreau on Aug. 31, 1915 for an identification tag housed similarly to a round-faced wristwatch. A cardboard tag identifying the individual is placed inside the round housing and is protected by a transparent celluloid covering. The device is worn on the wrist of the individual held there by a narrow strap.

A wrist tablet patent was granted to H. W. Weiss on Feb. 21, 1922, patent no. 1,407,239. The drawings show an openable flat case attachable to the user's wrist by a strap and buckle. A card inside can be written on in limited positions through slots in the outer case. A pencil is provided in a loop which is part of the case clasp.

C. E. Ziegler received patent no. 1,427,891, on Sept. 5, 1922. This device is an identification holder which can be worn on the wrist or wrapped around the frame of a bed.

The memorandum wrist watch shown in patent no. 1,539,781, granted to A. E. Smythe on May 26, 1925, illustrates a watch and a frame combination. The frame part is open and a card in the open frame can be written on.

The device in the past art patents which seemed most similar to my invention was in patent no. 2,553,676, issued to F. J. Roos on May 22, 1951. This shows attachments for wrist watch straps and bracelets and one attachment includes a memo pad.

Other patents seen which were considered interesting only included patent no. 1,701,888, G. F. Hofferberth, dated Feb. 12, 1929, a "Golf Scorer" for wrist attachment; and a cuff memorandum device patent granted to C. Stupell, no. 2,776,848, on Jan. 8, 1957.

A fault which appears common to most devices seen in past art patents is a tendency to be cumbersome. Most of the viewing or writing fixtures were oversized making the devices difficult to wear and unhandy to use. Identification holders in the nature of the Zeigler device are commonly seen in hospitals in a more compact form. The memo pad device of J. F. Roos (Union of South Africa) appears somewhat complicated but serviceable for its time period. Advances in technology allows a much less involved device today to accomplish the same ends with greater efficiency. My invention, using today's versatile materials and updated technology, provides a unique memorandum wristband having exchangeable coverings protecting a storage area and a non-permanent writing surface.

SUMMARY OF THE INVENTION

In practicing my invention I have developed an adjustable wristband which can be manufactured from a variety of modern-day materials including plastics, leathers, and cloths. The wristband is adjustable to the wrist size of the wearer and can be fastened around the wearer's wrist by two free ends with hook and loop style fasteners. A plastic snap buckle and a metal pressure type buckle can also be used. A small rectangular base plate, positioned centrally along the length of the wristband, is affixed on the outer surface of the wristband in longitudinal alignment with the sides. The outer surface area of the rectangular base plate is a smooth non-porous plastic. This plastic surface is designed to be written on with dry-erase markers or other suitable markers. The writing can later be removed with a tissue. A transparent covering which fits like a cap over the writable surface area is provided to prevent smudging of the message and can also be used to enclose a note card or other item between the two surfaces. The transparent covering has an inner ledge which snaps over projecting ridges located on either end of the write-on surfaced base plate. A decorative opaque cap attachable to cover the write-on surface is also provided as a protective cover. Although the preferred transparent covering and protective cap are snap-ons, both the transparent covering and the decorative opaque cap can be attached by hinges at one end of the base plate.

My wristband with the unique write-on features and coverings can be used as a memorandum for forgetful children and adults or as a storage area for a variety of items such as money, tickets or keys. The opaque decorative cap provides an aesthetic appearance and a concealing closure.

A primary object of my invention, then, is to provide an adjustable wristband with a platform base accepting snap-on attachment useful in a variety of memorandum and storage applications.

Another object of the invention is to provide an adjustable wristband with a non-permanent write-on platform which can be written on by available erasable markers as reminder notes and the writing protected from smudging by a removable transparent covering.

A further object of the invention is to provide an adjustable wristband with a storage compartment having a removable concealing cover.

A still further object of the invention is to provide an adjustable wristband for practical and for jewelry applications whereon attachments can be fastened and removed for both practical purposes and for enhancement of the wearer's attire.

Other objects and advantages of my invention will become apparent with a reading of the following specification and subsequent comparison of numbered parts described with similar numbered parts illustrated in the accompanying drawings.

BRIEF DESCRIPTION OF THE DRAWINGS

In the drawings:

FIG. 10 is an in-use view illustrating the wristband being worn by the user and the writing surface in the process of being written on.

DESCRIPTION OF THE PREFERRED EMBODIMENT

Figure 1:
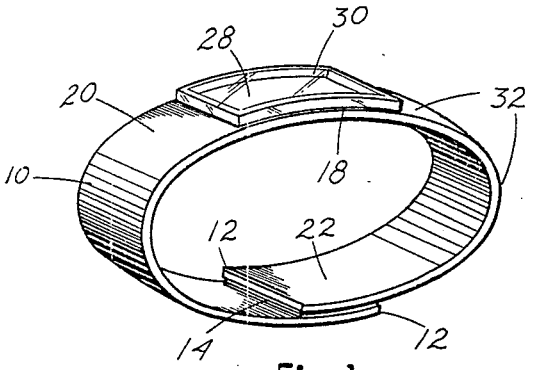
FIG. 1 is a perspective view of the invention.
Figure 2:
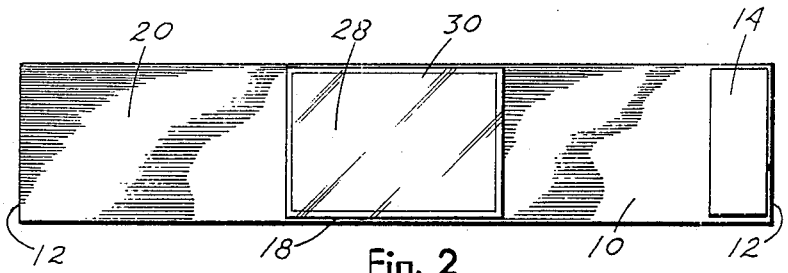
FIG. 2 is a top plan view showing the outer surface of the wristband.
Figure 3:
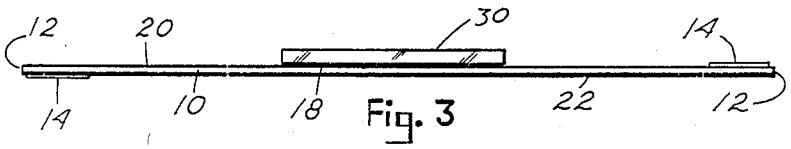
FIG. 3 is a right side view thereof.
Figure 4:
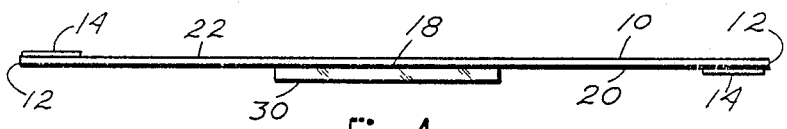
FIG. 4 is a left side view thereof.
Figure 5:
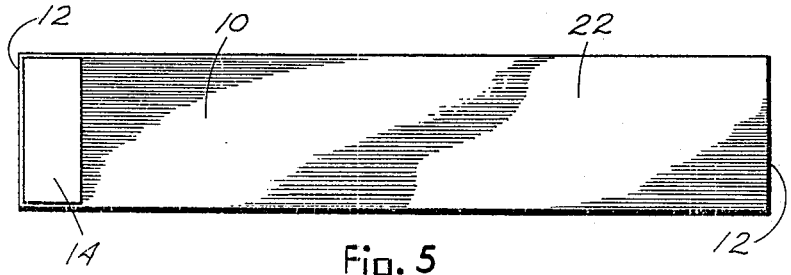
FIG. 5 is a view showing the inner surface of the wristband.
Figure 6:
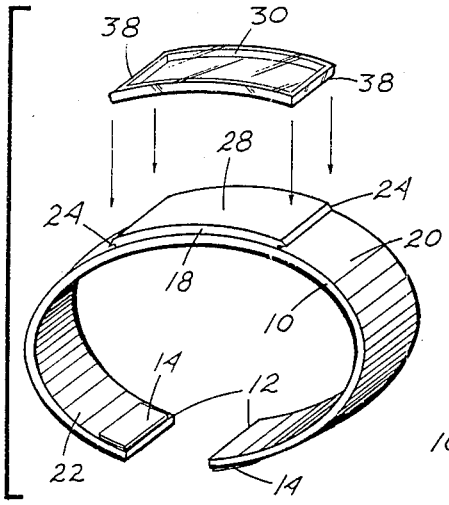
FIG. 6 is a perspective unassembled view of the wristband and protective transparent covering.
Figure 7:
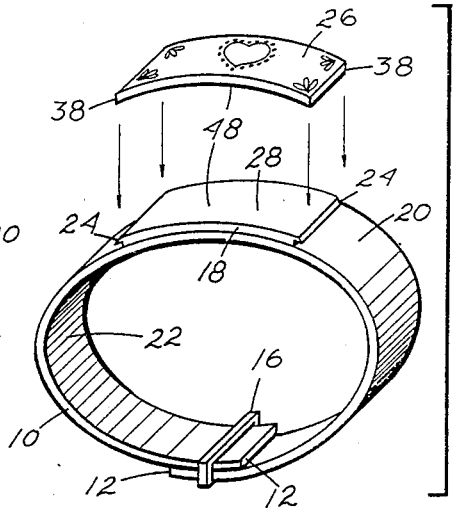
FIG. 7 is a perspective unassembled view of the wristband and decorative opaque cap.
Figure 8:
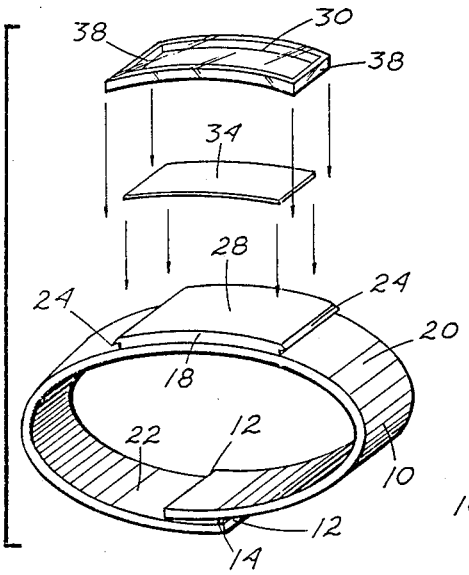
FIG. 8 is a perspective unassembled view of the transparent covering, a note card, and the wristband.
Figure 9:
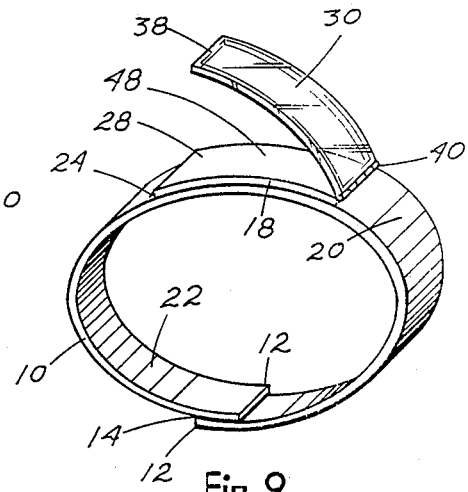
FIG. 9 is a perspective view of the wristband showing hinging attachment for the transparent covering and the storage area is indicated.

Referring now to the drawings at FIGS. 1 through 5 where adjustable wristband 10, which can be manufactured from a variety of modern-day materials including plastics, leathers, and cloths, is illustrated. For descriptive purposes, the outer and inner surfaces of adjustable wristband 10 are designated as wristband outer surface 20 and wristband inner surface 22. Two free ends 12 can be fastened together by hook and loop style fasteners 14 or by pressure type buckle 16. A small rectangular write-on base plate 18 is positioned centrally to the longitudinal length of adjustable wristband 10 and is affixed on the outer surface of adjustable wristband 10 in longitudinal alignment with adjustable wristband 10. Write-on base plate 18 has base plate projecting ridges 24 at both shorter ends arranged to accept snap-on attachments. The rectangular surface of write-on base plate 18 is a smooth non-porous plastic writing surface 28 designed to be written on with a dry-erase marker 36 or another suitable marker. The writing can be removed with a tissue. Transparent covering 30 with snap-over edge 38 snaps down over write-on base plate 18 over base plate projecting ridges 24 and is provided as protection and viewing for the writing surface 28 area to prevent smudging of writing 46. Material pliability 32 in the materials used to fabricate adjustable wristband 10 and the various connective parts allows snap-over attachments and curving somewhat of a flat transparent covering 30 (FIGS. 1–4) to fit the shape of wearer's wrist area. Transparent covering 30 can also be used to enclose a note card 34 or other item between the two surfaces. Decorative opaque cap 26 with snap-over edges 38 which fit over base plate projection ridges 24 is provided as a jewelry attachment and as a concealing protective cover for small items kept in storage area 48. Decorative opaque cap 26 and transparent covering 30 for some applications can be attached by cover attachment hinges 40 at one end to rectangular write-on base plate 18.

Figure 10:
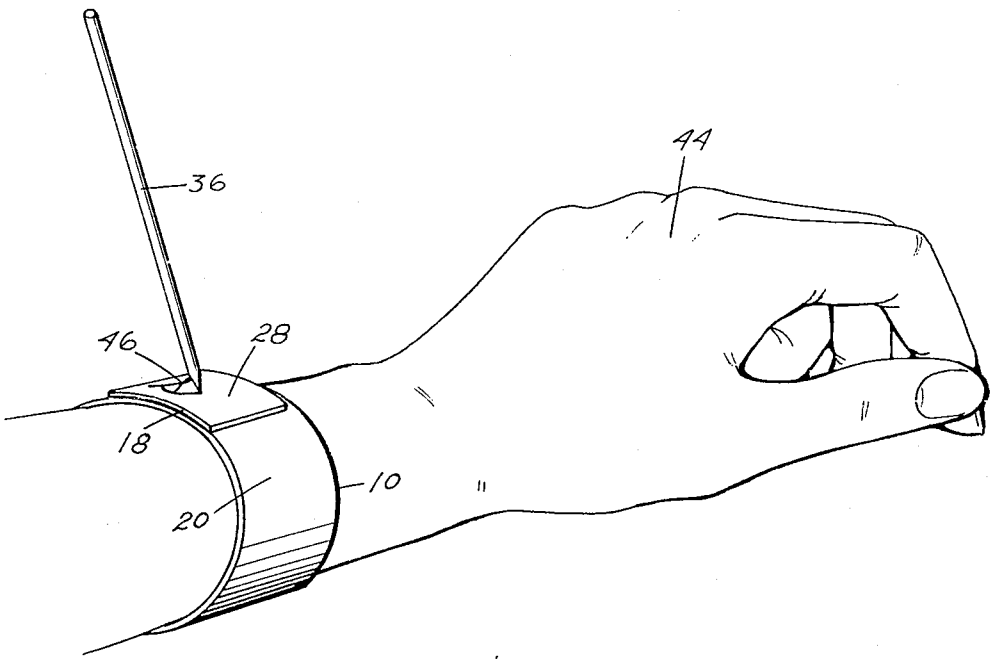

Adjustable wristband 10 worn on the lower arm in wearer's wrist area adjacent wearer's hand 44 can be used as a look-at memorandum for forgetful children and adults or as a simple visual memory jogger. FIG. 10 shows dry-erase marker 36 positioned for marking writing 46 on writing surface 28. In storage area 48, a variety of items such as money, tickets or keys can be conveniently secured. Decorative opaque cap 26 conceals stored items and provides adjustable wristband 10 with an aesthetic appearance.

Although the foregoing specification describes the invention in its preferred practical forms, it is to be understood that the structure shown is capable of modification within a range of equivalents with these modifications acceptable so long as the modifications remain within the intended scope of the appended claims.

The embodiments of the invention in which an exclusive property or privilege is claimed are defined as follows:

1. An adjustable memorandum wristband comprising:
   a longitudinally extending strap with an outer surface, an inner surface, and two end portions, means at each said end portion to releasably and adjustably secure said end portions together;
   a rectangular plate, said plate having an inner surface and an outer surface, said inner surface being affixed to one surface of said wristband, the outer surface of said plate comprising an easily erasable surface, at least the outer surface of said plate comprising means adapting said surface to be written upon by a dry erase marker;
   a first covering means comprising a generally rectangular box-shaped cap such that said cap can substantially cover at least said plate outer surface; and
   means on said plate and on said cap which cooperate to releasably secure said cap to said plate.

2. The wristband of claim 1 wherein said means for securing said end portions together comprises a buckle type fastener.

3. The wristband of claim 1 wherein said means for securing said end portions together comprises a hook and loop type fastener.

4. The wristband of claim 1 wherein at least a portion of said cap is made of a transparent material, at least in part.

5. The wristband of claim 1 wherein said cap is made from opaque material.

6. The wristband of claim 1 wherein said means which cooperate to releasably secure said covering means to said plate comprise snap fitting means.

7. The wristband of claim 1 wherein said means which cooperate to releasably secure said covering means to said plate comprise hinge means.

* * * * *